United States Patent [19]

Head

[11] Patent Number: 4,509,301

[45] Date of Patent: Apr. 9, 1985

[54] MODULAR SHOOTING RANGE

[76] Inventor: Robert L. Head, 3501 Perenosa Bay Dr., Anchorage, Ak. 99515

[21] Appl. No.: 371,342

[22] Filed: Apr. 23, 1982

[51] Int. Cl.[3] ..... E04H 14/00; F41J 1/12; F41J 1/14

[52] U.S. Cl. ..... 52/79.8; 273/404; 273/410

[58] Field of Search ..... 273/404–410; 52/79.7, 79.8, 79.9

[56] References Cited

U.S. PATENT DOCUMENTS

| | | | |
|---|---|---|---|
| 1,995,573 | 3/1935 | Matthews | 52/79.9 |
| 2,356,992 | 8/1944 | Gilson | 273/410 |
| 2,535,280 | 12/1950 | Gartrell | 273/404 |
| 2,670,959 | 3/1954 | Broyles | 273/410 |
| 2,812,660 | 11/1957 | Marden et al. | 273/410 |
| 3,203,052 | 8/1965 | Curtis, Jr. | 52/204 |
| 3,398,959 | 8/1968 | Sanzare | 273/404 |
| 3,447,806 | 6/1969 | Pfaff et al. | 273/410 |
| 3,609,929 | 10/1971 | Brown et al. | 52/79.7 |
| 4,201,385 | 5/1980 | Szabados | 273/410 |

OTHER PUBLICATIONS

"Twin-Duty Target Box"; Marshall Lincoln Popular Mechanics; p. 141; Jun. 1974.

National Rifle Association; p. 22, "Part Time Special Ranges."

National Rifle Association, *NRA Part-Time Special Ranges.*

National Rifle Association, *Planning and Design of Outdoor Ranges.*

National Rifle Association, *High-Power Range Supplement to Planning and Design of Outdoor Ranges.*

National Rifle Association, *Range Location and Landscaping.*

National Rifle Association, *Small Bore Range Plans.*

National Rifle Association, *Outdoor Pistol Range Plans.*

National Rifle Association, *Indoor Rifle and Pistol Ranges.*

National Rifle Association, *Range Tips.*

National Rifle Association, *Running Game Ranges.*

National Rifle Association, *Shotgun Shooting Facilities Plans.*

National Institute for Occupational Safety and Health, "Lead Exposure and Design Considerations for Indoor Firing Ranges", Dec. 1975.

*Primary Examiner*—Donald G. Kelly

*Assistant Examiner*—Michael Safavi

*Attorney, Agent, or Firm*—Ward Brown; Robert W. Beach

[57] ABSTRACT

An enclosed, substantially bulletproof shooting booth for an individual shooter has a front shooting opening communicating with the interior of an elongated, substantially bulletproof firing tube extending from the booth. The end of the firing tube remote from the shooting booth is closed by a bullet backstop which deflects bullets fired from the booth and collects them in a trough of liquid. The booth, tube and backstop are of double-wall construction with a bulletproofing and noise-suppressing layer of sand between inner and outer walls. Each of the booth, tube and backstop can be at least partially prefabricated at a remote location and transported to a desired range site where they are installed above ground so as to form a space-saving, quiet, enclosed shooting range for an individual shooter.

9 Claims, 10 Drawing Figures

MODULAR SHOOTING RANGE

BACKGROUND OF THE INVENTION

1. Field of the Invention

The present invention relates to facilities designed for firearms training and practice, commonly known as shooting ranges.

2. Prior Art

Various considerations in shooting range design and construction are discussed in the following booklets distributed by the Range Development Division of the National Rifle Association of America, 1600 Rhode Island Avenue, Washington, D.C. 20036:

NRA Part-Time Special Ranges;
Planning and Design of Outdoor Ranges;
High-Power Range Supplement to Planning and Design of Outdoor Ranges;
Range Location and Landscaping;
Small Bore Range Plans;
Outdoor Pistol Range Plans;
Indoor Rifle and Pistol Ranges;
Range Tips;
Running Game Ranges;
Shotgun Shooting Facilities Plans; and
NIOSH Technical Information—Lead Exposure and Design Considerations For Indoor Firing Ranges.

In general, the shooting ranges disclosed in the foregoing publications are permanent facilities constructed on site. Safety, of course, is a primary consideration, particularly with respect to the design and construction of bullet backstops located behind the target area. For outdoor ranges a large plot of land is required, and for indoor ranges a closed, bulletproof room is required, to assure that stray bullets do not leave the range. Nevertheless, there is the possibility of injury to participants and onlookers at the range, particularly from accidential misfires which may not be directed toward the targets. There also is the possibility of injury to unauthorized persons who wander into the range.

Noise also can be a problem, such as when an outdoor shooting range initially is located in a remote area, as is customary, and the surrounding area later is developed for other commercial or for residential purposes. Various steps can be taken to lessen noise somewhat, but the only practical solution may be to abandon the shooting range and construct a new range in another area.

Another problem with outdoor ranges is that they can be used only when the weather permits, and in cold climates the limited time during which the range may be used may not justify the cost of the large area required and the expense of construction.

In the "Maryland Nat'l Guard Tube Range" described at pages 5 and 6 of the booklet *NRA Part-Time Special Ranges,* several individual, open-ended, parallel "firing tubes" were constructed at ground level with corresponding ends of the tubes closely adjacent to a hill serving as a bullet backstop. The shooters kneel or stand in a trench dug adjacent to the other ends of the tubes, or lie in prone position with the trench covered over, and shoot through the tubes at targets supported outside the tubes next to the hill.

At pages 22 through 24, the *NRA Part-Time Special Ranges* booklet also describes "An Underground Range" in which bullets are shot through an underground concrete pipe from a "shooting house" to a "target bunker".

SUMMARY OF THE INVENTION

It is an object of the present invention to provide a shooting range in which users of the range are protected against injury from firing of others at the range, even from accidental misfires.

It is also an object to provide such a range requiring a minimum amount of space.

An additional object is to provide such a range in which noise is minimized.

A further object is to provide such a range of component parts which may be constructed at one location and shipped to another location for final assembly, and which may be disassembled and moved to and reinstalled at a different location.

Another object is to provide such a range which may be used comfortably year around, even during inclement weather.

Still another object is to provide such a range including a station for a range master who, from that location, may observe the activities of each user of the range.

Yet another object is to provide such a range which is of simple, inexpensive construction and easy to assemble and install.

The foregoing objects can be accomplished by providing an enclosed, modular shooting range including a substantially bulletproof shooting booth component for an individual shooter, a substantially bulletproof firing tube extending from a shooting opening in a wall of the booth, and a bullet backstop component connected to the remote end of the firing tube component, each component being at least partially prefabricated at a remote location and being transported to and assembled to the other components at a desired range site.

The shooting booth component is of double-wall construction with the space between inner and outer walls filled with sand to bulletproof the booth.

The firing tube also is of double-wall construction including a sheet metal liner for deflecting misdirected bullets fired down the tube. Stiffening metal frames encircle the liner and space outward from it panels forming an outer sleeve encircling the liner. The space between the outer sleeve and the inner liner is filled with sand to reinforce the liner and for noise suppression.

The bullet backstop component includes a top bullet deflector plate and a bottom plate angled downward from the ceiling and floor, respectively, of the firing tube liner. Upright sidewalls and a steeply angled end plate extend between the top and bottom plates of the bullet backstop and form a trough which is filled with liquid to trap bullets deflected by the top deflector plate.

Several of the individual ranges can be arranged projecting generally radially from a range master's station so that the range master may view the activities of each shooter through a window in the rear of each shooting booth.

DETAILED DESCRIPTION OF THE PREFERRED EMBODIMENT

Figures 1, 2, 3:
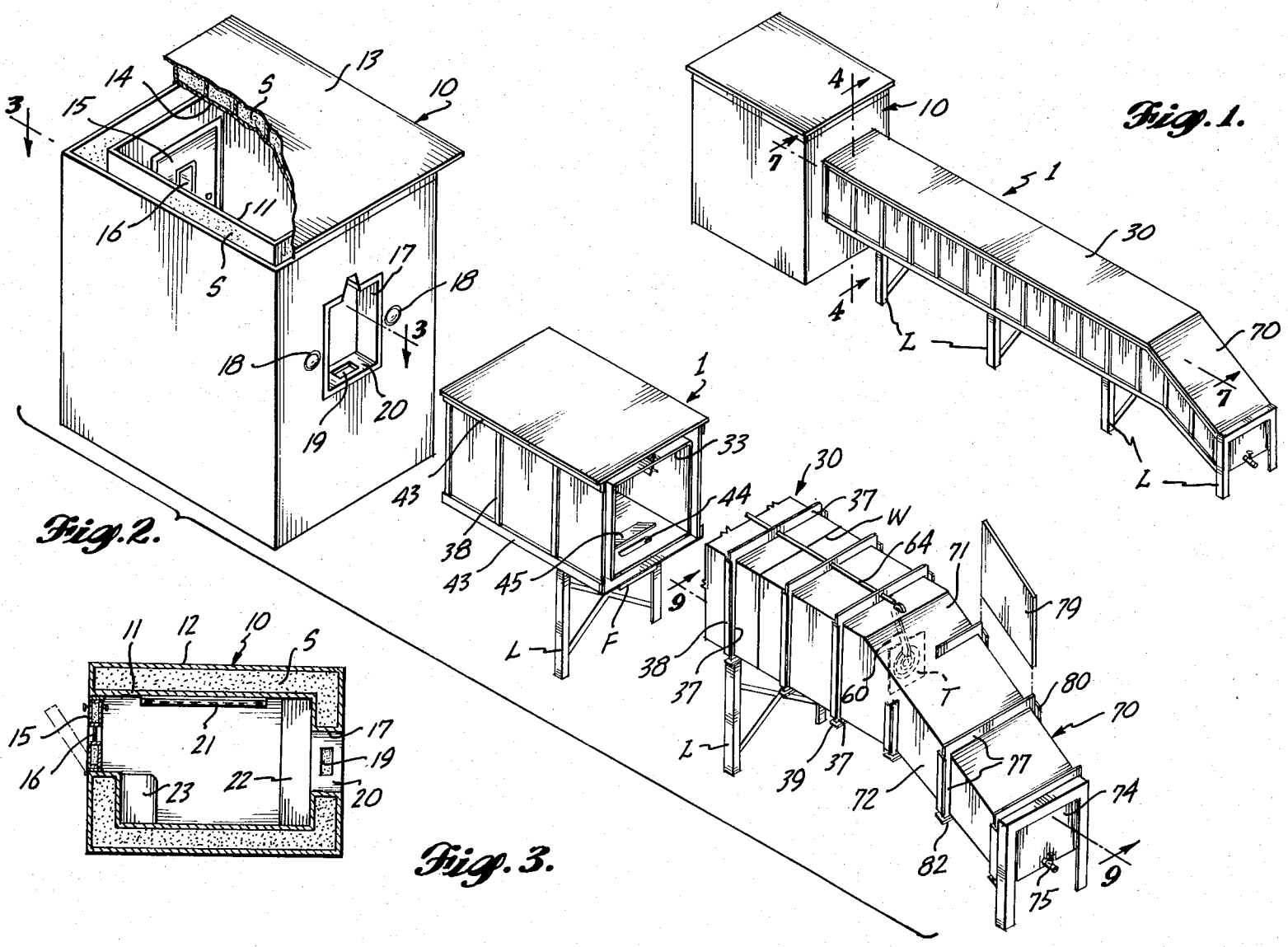
FIG. 1 is a somewhat diagrammatic, top perspective of a modular shooting range in accordance with the present invention which includes a shooting booth, a firing tube and a bullet backstop.
FIG. 2 is a top perspective of the shooting range of FIG. 1 drawn on a larger scale with parts broken away.
FIG. 3 is a horizontal section through the shooting booth of FIGS. 1 and 2, taken along line 3—3 of FIG. 2.

As shown in FIG. 1, each individual shooting range 1 in accordance with the present invention includes three major components, namely, an enclosed, bulletproof shooting booth 10, a bullet backstop 70 and a bulletproof firing tube 30 extending between the booth and the backstop. All components are removably supported above ground with the firing tube and the bullet backstop being supported by suitable legs L.

A shooter stands, sits or kneels in the shooting booth and shoots through the firing tube at a retrievable target normally supported at the remote end of the tube. The bullet backstop deflects and collects the discharged bullets. Each component can be manufactured separately and transported to a desired area for final assembly. Similarly, if it is desired to move the range, the components can be disassembled and transported to a new location.

As best seen in FIGS. 2 and 3, the shooting booth 10 is of double-wall construction including a inner upright wall 11 and an outer upright wall 12, with a layer of sand S filling the space between the walls and of a thickness sufficient to trap any misdirected bullets should the shooter's firearm be inadvertently discharged inside the booth. The outer roof covering 13 for the booth is spaced upward a substantial distance from the inner ceiling 14, again with a bulletproof layer of sand S between them. Similarly, the access door 15 closing the rear of the booth is of bulletproof construction and includes a bulletproof window 16. Preferably the exposed inner surfaces of the upright walls, ceiling and door are wood material so as to decrease the tendency of misdirected bullets to ricochet inside the booth.

The front wall of the shooting booth 10 has a rectangular opening 17 through which it is intended that the shooter's firearm be discharged. Such opening is flanked by spotlights 18 for illuminating the target area of the range. A hole 19 through the bottom sill 20 of the opening 17 communicates with the sand-filled inner core of the double-walled booth. During final assembly of the booth, sand is poured through the hole 19 to prevent any voids occurring beneath the opening 17.

As shown in FIG. 3, the booth can include an electric resistance heater 21, a shelf 22 adjacent to the shooting opening 17 and a seat 23 adjacent to the access door 15. Outside ventilation air is supplied into the booth through a baffled vent (not shown) in the lower portion of the access door.

Figure 5:
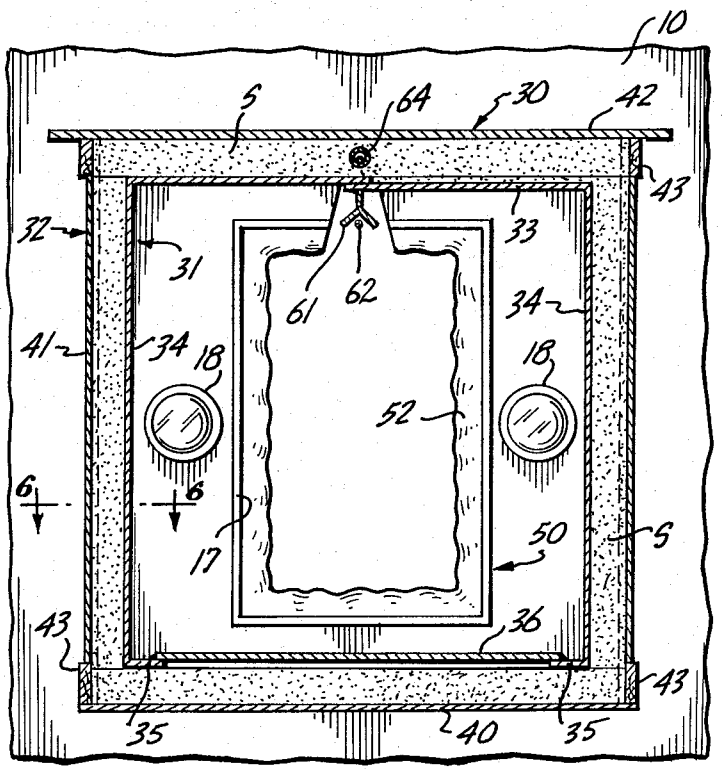
FIG. 5 is a transverse, vertical section through such firing tube, taken along line 5—5 of FIG. 4.

As best seen in FIG. 5, one end of the firing tube 30 is secured to the front wall of the shooting booth so as to encircle the shooting opening 17 and the lights 18 adjacent to it. The firing tube also is of double-wall construction including an inner tube or liner 31 and an outer tube or sleeve 32 with a noise-suppressing and liner-reinforcing layer of particulate filler material, preferably sand S filling the space between the inner liner and the outer sleeve and completely encircling the inner liner. The liner 31 is formed from three separate pieces of metal sheet material, such as two opposite sides and a bottom extending lengthwise of the firing tube, the adjacent edges of which can be welded together. The ceiling 33 of the linear 31 is formed by long overlapping flanges bent inward from the upper portions of the upright liner sidewalls 34 forming a welded seam extending longitudinally of the liner. Short flanges 35 are bent inward feom the bottom edge portions of the sidewalls 34 supporting the planar floor section 36. Adjacent liner sections can be welded together end-to-end, such as at the weld line W indicated in FIG. 2, so as to form a firing tube of a desired length.

The liner metal sheet material should be of a type and thickness sufficient to prevent penetration through it of bullets striking the linear at a small angle. It is believed that the layer of sand held against the liner reinforces it somewhat against such penetration in addition to soundproofing the firing tube.

Figure 6:
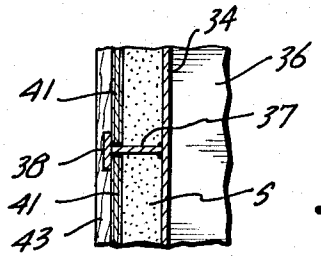
FIG. 6 is an enlarged, fragmentary, transverse, horizontal section through such firing tube, taken along line 6—6 of FIG. 5.

As best seen in FIG. 2, at locations spaced at regular intervals along the length of the firing tube 30, such as every 2 feet (0.6 meters), braces or stiffeners 37 of metal flat stock material are welded to the exterior of the upright sidewalls, ceiling and floor of the liner 31 and project outward from it so as to form stiffening collars or frames encircling the firing tube liner. As shown in FIG. 5, the top brace or stiffener extends continuously across the ceiling 33 of the liner and, more specifically, across the welded seam connecting the opposite side portions of the ceiling. As best seen in FIG. 6, metal strips or plates 38 are welded to the outer edges of the stiffeners 37 projecting from the sidewalls 34 so as to form flanges projecting longitudinally of the tube in both directions from the sidewall stiffeners and spaced outward from the liner sidewalls to form T-section frames. Similarly, as best seen in FIG. 4, metal plates or strips 38 are welded to the bottom edge portions of the stiffeners 37 projecting downward from the floor 36 of the liner so as to form flanges extending longitudinally of the tube in both directions from the floor stiffeners and spaced a substantial distance below the liner floor to form T-section stiffeners.

The outer tube of sleeve 32 of the firing tube is formed of panels, such as plywood, supported on the stiffeners 37 and their flange-forming plates 38. As best seen in FIG. 4, the bottom of the outer sleeve is formed by panels 40 having opposite end margins resting on the flanges formed by the plates 38. Similarly, as shown in FIG. 6, the upright sidewalls of the outer sleeve are formed of panels 41 having opposite end margins engaged against the inner surfaces of the flanges formed by the plates 38. The roof of the outer sleeve is formed of panels 42 laid over the stiffeners 37 projecting upward from the ceiling 33 of the inner liner 31. As seen in FIG. 5, the bottom and top panels 40 and 42 of the outer sleeve overlap the sidewall panels 41 and are nailed into wood strips 43 extending longitudinally of the sleeve along the top and bottom edge portions of the sidewall panels.

Circulation of air through and out of the firing tube 10 for removing noxious fumes is through one or more vent openings 44, shown in FIG. 2 in the bottom of the tube. Preferably, a short deflector plate 45 is inclined from the edge of each vent opening adjacent to the shooting booth, so that bullets will not strike the remote edge of the vent opening and ricochet rearward. A blower or fan F draws air from inside the tube downward through each vent opening and can be mounted on the exterior of the bottom of the outer sleeve.

Figure 4:
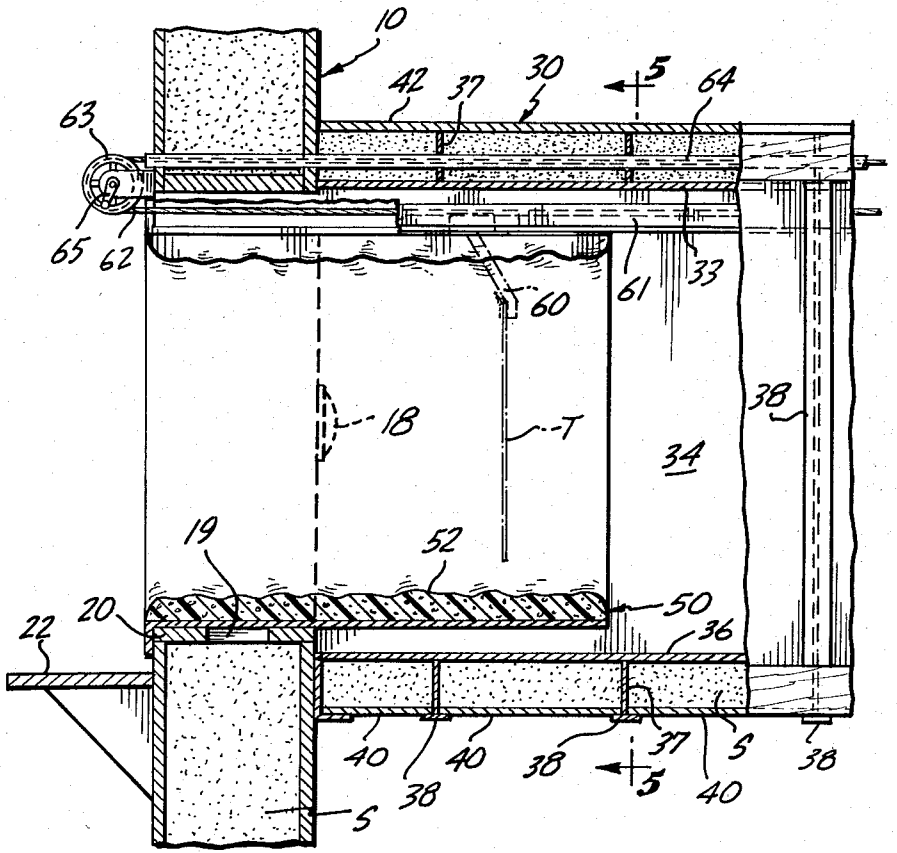
FIG. 4 is a fragmentary, longitudinal, vertical section through the firing tube of FIGS. 1 and 2, taken in the area of line 4—4 of FIG. 1.

As best seen in FIGS. 4 and 5, an open-ended, tubular noise suppressor 50 is mounted in the opening 17 extending through the front wall of the shooting booth 10 and projects outward from such opening into the near end portion of the firing tube. Such noise suppressor includes outward projecting stop flanges which engage against the inner wall of the booth to limit insertion of the suppressor through the shooting booth opening. An inner layer 52 of suitable noise-suppressing material is attached to the inner periphery of the suppressor so as to completely encircle the area where the muzzle of the shooter's firearm is intended to be located.

Figure 7:
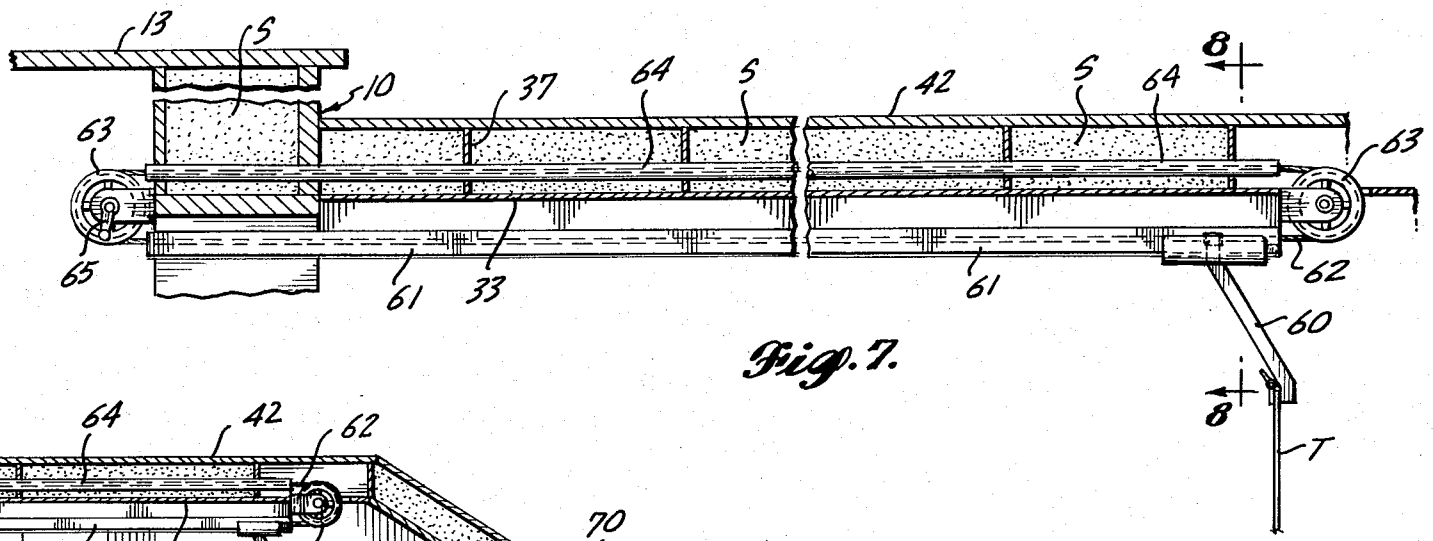
FIG. 7 is a fragmentary, longitudinal, vertical section through the upper portion of such firing tube, taken along line 7—7 of FIG. 1, with parts broken away, illustrating a target-retrieval system.
Figure 8:
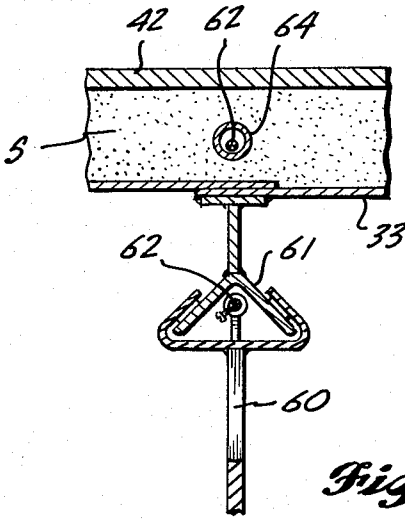
FIG. 8 is an enlarged, fragmentary, transverse, vertical section through the upper portion of such firing tube, taken along line 8—8 of FIG. 7.

As shown in FIGS. 7 and 8, a target T is supported from an arm 60 movably carried on a slide rail 61. Such rail projects downward from the liner ceiling 33 and extends the full length of the firing tube. The target may be moved along the rail between the remote or target end of the tube and the enclosed shooting booth by pulling a loop of cable or rope 62 attached to the arm 60 and extending around pulleys 63 supported at opposite ends of the tube. The upper run of the cable extends through a pipe 64 mounted between the liner ceiling 33 and the outer sleeve roof panels 42. A hand crank 65 or an electric motor can be provided for pulling the cable or rope so as to retrieve the target or place it at a desired location along the length of the firing tube.

Figure 9:
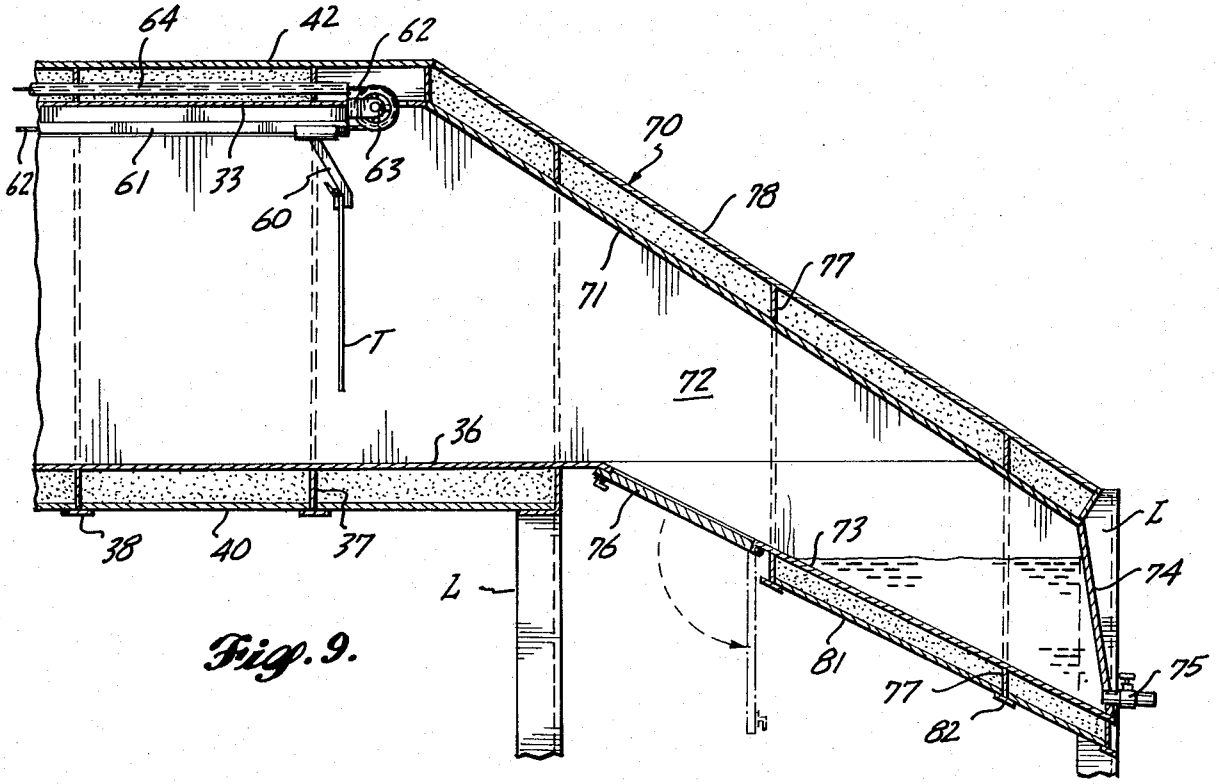
FIG. 9 is a fragmentary, longitudinal, vertical section through the bullet backstop component of the shooting range of the present invention, taken along line 9—9 of FIG. 2.

As shown in FIGS. 2 and 9, the bullet backstop component 70 of the shooting range is connected to the remote or target end of the firing tube 30, such as by welding. The inner top 71, sidewalls 72 and bottom 73 of the backstop are formed of metal sheet material of a type and thickness sufficient to prevent their penetration by bullets shot at the target T. The top 71 acts as a deflector plate, is inclined downward from a location above the ceiling 33 of the firing tube inne liner 31 to a location below the liner floor 36 and extends transversely at least the full width of the inner periphery of the liner. The bottom 73 of the backstop is inclined downward from the liner floor parallel to the top of the backstop.

The end of the backstop component remote from the firing tube is closed by a bulletproof metal end plate 74 welded to the top, sidewalls and bottom of the backstop, which end plate is inclined sharply downward and slightly rearward so as to guide bullets deflected by the top 71 into a trough formed by the lower portions of the end plate 74 and the sidewalls 72 and the lower end portion of the inclined bottom 73. The trough is filled with liquid to prevent bullets from ricocheting out of the trough. In addition, by catching the hot deflected bullets in liquid, lead fumes generated by the bullets are reduced. In cold climates, a mixture of water and antifreeze can be used, and the mixture can be drained from the trough through a spigot 75 in the bottom end portion of the backstop end plate 74. A swinging door 76 in the upper portion of the backstop bottom allows access to the trough for recovery of the spent bullets.

Similar to the construction of the firing tube, the bullet backstop component is braced by regularly spaced stiffeners 77 of metal flat stock material welded to and projecting outward from it. The top stiffeners support outer roof panels 78; outer sidewall panels 79 have opposite end margins engaging the inner surfaces of flanges formed by plates 80 welded to the outer edges of the sidewall stiffeners; and bottom panels 81 are supported on flanges 82 welded to the bottom edges of the bottom stiffeners. A noise-suppressing layer of sand S is confined between the inner backstop walls and the outer panels.

In constructing the range components at a location remote from the area where they are to be finally assembled, the upright wall and the roof shells of the shooting booth are constructed separately and can be transported to the desired location and then filled with sand. The inner liner of the firing tube is completely constructed in longitudinal sections, including its stiffeners 37 and the panel support plates 38 and 39, with the exception that the floor plates 36 are not installed. At the location of final assembly, the outer sleeve bottom and side panels of a longitudinal section are slid into place, the top and bottom wood strips 43 are attached, sand is placed over the bottom panels, and then the floor plates 36 are installed. After the tube sidewalls are completely filled with sand, the top layer of sand can be added over the liner ceiling 33, whereupon the roof panels may be laid over the ceiling stiffeners 37. Similarly, the metal bullet-catching portions of the backstop component and their stiffeners 77 and support plates 80 and 82 can be assembled at the remote location and transported to the range site, with the sand layer and the outer panels 78, 79 and 81 being added at the site.

Figure 10:
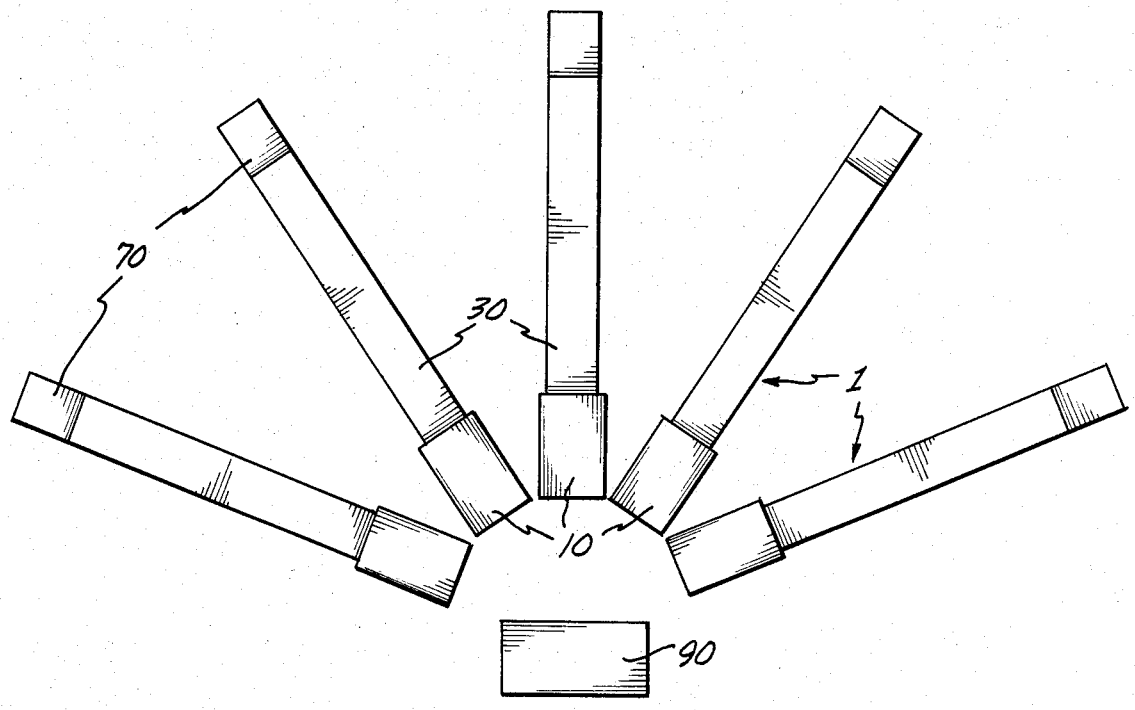
FIG. 10 is a diagrammatic, top plan of a modular shooting range in accordance with the present invention having several individual shooting ranges of the same construction as that shown in FIGS. 1 through 9.

As indicated in FIG. 10, several of the individual shooting ranges 1 in accordance with the invention can be arranged projecting generally radially from a station 90 for a range master so that a single range master can observe the activities of each shooter through the window in the door closing the rear of that shooter's booth 10. Since each shooter is confined in his or her own bulletproof booth, each shooter is protected against injury from firing of others, even from accidental misfires. The closed, bulletproof firing tube 30 and backstop 70 prevent any bullets from escaping the individual ranges, greatly reducing the area required for the range. Substantial noise suppression is effected by the sand layers in the double walls of each range component, so that the range need not necessarily be located in a remote area. An additional desirable result achieved by provision of a closed shooting range in accordance with the present invention is that the range is usable comfortably in virtually all climates, regardless of weather conditions.

I claim:

1. A firing tube for use in a shooting range comprising a generally tubular liner of metal sheet material, and panels for forming an outer sleeve completely encircling said liner, said liner having stiffeners projecting outward therefrom for supporting said panels spaced from the tube of said liner leaving room for filler material between said sleeve and said tube, and said liner including laterally spaced, upright sidewalls, integral flanges bent inward from the upper portions of said sidewalls, respectively, and interconnected so as to form a ceiling and a floor plate for extending generally between the lower portions of said sidewalls.

2. A firing tube for use in a shooting range comprising a generally tubular liner of metal sheet material, and panels for forming an outer sleeve completely encircling said liner, said liner having stiffeners projecting outward therefrom for supporting said panels spaced from the tube of said liner leaving room for filler material between said sleeve and said tube, and said liner including laterally spaced, upright sidewalls, integral flanges bent inward from the lower portions of said sidewalls, respectively, a floor plate for resting on said flanges and a ceiling extending generally between the upper portions of said sidewalls.

3. A firing tube for use in a shooting range comprising an elongated, generally tubular inner liner, a plurality of stiffening frames spaced longitudinally of said liner and each closely encircling said liner, an outer sleeve having panels supporting on said frames so as to be spaced outward from said liner, and a layer of filler material between said sleeve and said liner and encircling said liner, and including a panel supporting plate attached to an edge of one of said stiffening frames remote from said liner so as to form a flange projecting longitudinally of said liner and spaced outward therefrom, a panel of said sleeve having an end margin engaged against the inner side of said flange.

4. A firing tube for use in a shooting range comprising an elongated, generally tubular inner liner, a plurality of stiffening frames spaced longitudinally of said liner and each closely encircling said liner, an outer sleeve having panels supported on said frame so as to be spaced outward from said liner, a layer of filler material between said sleeve and said liner and encircling said liner, and means for supporting said liner and said sleeve spaced above the ground, said liner and said sleeve having registered apertures through the bottoms thereof for forming a vent opening through the bottom of the tube.

5. The firing tube defined in claim 4, including a bullet deflector plate inclined upward generally from an edge of the aperture through the liner and extending laterally inside the liner throughout the entire lateral width of such aperture.

6. The firing tube defined in claim 4, including means mounted to the bottom of the sleeve adjacent to its aperture for drawing air from inside the liner.

7. A shooting range comprising a range master station and several elongated firing tubes extending generally radially from the range master station.

8. The shooting range defined in claim 7, including a separate enclosed, substantially bulletproof shooting booth for each of the firing tubes, said shooting booths being connected, respectively, to the ends of the firing tubes adjacent to the range master station, each of said shooting booths having a rear window enabling a person at the range master station to see into each booth through said windows.

9. A firing tube for use in a shooting range comprising a generally tubular liner of metal sheet material and panels for forming an outer sleeve completely encircling said liner, said liner having stiffeners projecting outward therefrom for supporting said panels spaced from the tube of said liner leaving room for filler material between said sleeve and said tube, said liner including at least one longitudinally-extending welded seam and said stiffeners including corresponding stiffener plates each extending transversely of the length of said liner continuously and unbrokenly over said seam.

* * * * *